United States Patent [19]

Vukmanic et al.

[11] Patent Number: 4,525,973

[45] Date of Patent: Jul. 2, 1985

[54] SUSPENDED CEILING SYSTEM

[75] Inventors: Ronald W. Vukmanic, Naperville; John S. Borucki, Bloomingdale; Chester A. Stanley, Des Plaines, all of Ill.

[73] Assignee: Chicago Metallic Corporation, Chicago, Ill.

[21] Appl. No.: 569,454

[22] Filed: Jan. 9, 1984

[51] Int. Cl.[3] ..... E04C 2/42; F16B 7/22

[52] U.S. Cl. ..... 52/667; 52/484; 403/346

[58] Field of Search ..... 52/664, 665, 667, 668, 52/666, 484, 669; 403/346, 347

[56] References Cited

U.S. PATENT DOCUMENTS

| | | | |
|---|---|---|---|
| 3,023,861 | 3/1962 | Bak . | |
| 3,193,063 | 7/1965 | Brown et al. | 52/667 |
| 3,221,466 | 12/1965 | Downing, Jr. et al. . | |
| 3,292,332 | 12/1966 | Jahn | 52/484 |
| 3,297,345 | 1/1967 | Downing, Jr. . | |
| 3,312,488 | 4/1967 | Lickliter et al. . | |
| 3,354,598 | 11/1967 | Nicholson . | |
| 3,356,402 | 12/1967 | Smith . | |
| 3,378,976 | 4/1968 | Meredith, Jr. . | |
| 3,396,997 | 8/1968 | Adams . | |
| 3,399,915 | 9/1968 | Stanzak . | |
| 3,501,185 | 3/1970 | Brown et al. . | |
| 3,550,341 | 12/1970 | Thompson . | |
| 3,677,589 | 7/1972 | Raes | 52/665 X |
| 3,722,167 | 3/1973 | Rousey . | |
| 3,746,379 | 7/1973 | Sauer . | |
| 3,898,784 | 8/1975 | Sauer et al. . | |
| 3,921,363 | 11/1975 | Beynon . | |
| 3,922,829 | 12/1975 | Sauer . | |
| 3,928,950 | 12/1975 | Beynon . | |
| 3,979,874 | 9/1976 | Cubbler, Jr. et al. . | |
| 4,106,878 | 8/1978 | Jones . | |
| 4,108,563 | 8/1978 | Brown et al. . | |
| 4,161,856 | 7/1979 | Brown et al. . | |
| 4,314,432 | 2/1982 | Rosenbaum . | |
| 4,317,318 | 3/1982 | Sauer . | |
| 4,317,641 | 3/1982 | Sauer . | |
| 4,364,686 | 12/1982 | Sharp et al. . | |
| 4,389,828 | 6/1983 | Cary | 52/665 |

*Primary Examiner*—J. Karl Bell

*Assistant Examiner*—Richard E. Chilcot, Jr.

*Attorney, Agent, or Firm*—Hill, Van Santen, Steadman & Simpson

[57] ABSTRACT

A suspended ceiling system having main runners and/or members extending parallel with the cross members spaced therealong to form rectangular sections, the cross members being provided with tongues extending from the end and received in an aperture or slot in the web of the main member with the tongue being provided with spaced abutment surfaces separated by an elongated aperture extending parallel to a bead of the cross member and the tongue having abutment surfaces and flaps for coacting with the tongue from the opposite direction to form an end-to-end connection between the cross members. The elongated aperture besides spacing the two abutment surfaces that engage the web of the main member to hold the cross member in place provides an aperture on each side of the web of the main member for receiving a clip such as a seismic clip to positively lock the members together.

9 Claims, 6 Drawing Figures

SUSPENDED CEILING SYSTEM

BACKGROUND OF THE INVENTION

The present invention is directed to a connection between a cross member and a main member for a suspended ceiling support structure which has a plurality of main or runner members extending parallel to each other and cross members extending between the main members at spaced intervals. Each of the members has an inverted T-configuration with a pair of oppositely extending flanges connected by a web portion to a bead. A connection for connecting the cross member to the main member comprises a tongue extending from the end of the cross member through an elongated slot in the web of the main member. To hold the tongue in the slot, the web is provided with abutment surfaces to engage the edge of the slot and the tongue is also provided with an arrangement of abutment surfaces and a tab which form an end-to-end connection with a tongue of another cross member extending through the slot from the opposite side.

Suspended ceiling support systems or structures, which utilize a plurality of main runners and cross members are shown by U.S. Pat. No. 3,023,861. In this patent, the cross members have a different shape or configuration from the main members and have tongues extending through slots in the main members. To lock the tongues in the slots, nails extend through the apertures in the tongues.

It is also known that both the cross members and the main members have substantially the same configuration and that the cross members have tongues with means for locking the cross member in an aperture or elongated slot in the web of the main member. Examples are disclosed in U.S. Pat. Nos. 3,396,997; 3,399,915; 3,501,185; 3,922,829 and 4,317,641. These patents will also show various configurations for the cross section of the members with the cross section having a web formed by a double layer which joins a bead to a pair of opposing flanges such as taught by U.S. Pat. No. 3,922,829. The apertures can have various configurations such as taught by U.S. Pat. No. 3,501,185 and the end surfaces of the bead and flanges may be offset so that during assembly the bead engages the bead of the main member as the end of the flange engages the side of the flanges of the main member as taught by U.S. Pat. No. 3,399,915. Also, U.S. Pat. Nos. 3,396,997 and 3,399,915 disclose locking means which utilize a plurality of tabs forming spaced abutment surfaces.

SUMMARY OF THE INVENTION

The present invention is directed to an improved suspended ceiling structure or system which has members with a bead connected to the opposite flanges by a web with a double thickness to increase strength and has a locking means for connecting the tongue of a cross member in a slot of the main member which includes an elongated aperture that enables inserting one or more clip means to positively lock the device together.

To accomplish these goals, the present invention is directed to a suspended ceiling structure comprising main members extending parallel to each other and cross members extending between the main members at spaced intervals, each of said members having an inverted T-configuration with a pair of oppositely extending flanges connected by a web portion to a bead, each cross member having ends with an end surface of the bead extending beyond the end surfaces of the flanges by an amount slightly less than the width of a single flange and the web portion having a tongue extending beyond both end surfaces. Each of the webs of the main members have elongated slots for receiving the tongues of the cross members with the end surfaces of the bead contacting the bead of the main member as the end surfaces of the flanges of the cross member engage the outer edge of the flange of the main member. Each of the tongues has first means cooperating with the elongated slot to lock the tongue in the slot and second means cooperating with the second means of another tongue to interlock the two tongues together to form an end-to-end joint. The first means include a pair of tabs bent from the web forming a pair of catch surfaces facing away from the end of the tongue, said tabs being spaced apart by an elongated aperture extending parallel to the bead and being positioned in the tongue with a portion extending on each side of the web of the main members to provide an aperture for receiving a clip means for positive locking of the cross member to the main member.

Preferably, the web of each of the members is a double thickness so that the tabs bent from the tongue form a catch surface having a double thickness for engaging the web of the main member. The elongated aperture or slot in the web of the main members has preferably a rectangular configuration with short sides parallel to the bead and the long sides being perpendicular to the flanges. Each of the short sides has a projection or nib dividing the short side into two parts and the center of the long side has a slight projection. Thus, when a tongue is inserted in the aperture, the nibs of the short sides hold the tongue against one of the long sides with the tabs engaging the protection of the long side.

To interconnect two of the cross members together while having their tongues being received in opposite sides of the slot, each tongue is provided with a rearwardly facing abutment surface on a projection adjacent the end of the tongue. In addition, the second means includes a flap or tab bent out of the tongue at a point spaced a substantial distance from the end to form an edge and a catch that receives the end of the oppositely extending tongue as the edge is engaged by the abutment surface of the protrusion.

DESCRIPTION OF THE PREFERRED EMBODIMENTS

The principles of the present invention are particularly useful in a suspended ceiling system generally indicated at 10 which comprises a plurality of main runners or members 11 and cross members or runners 12.

Figure 1:
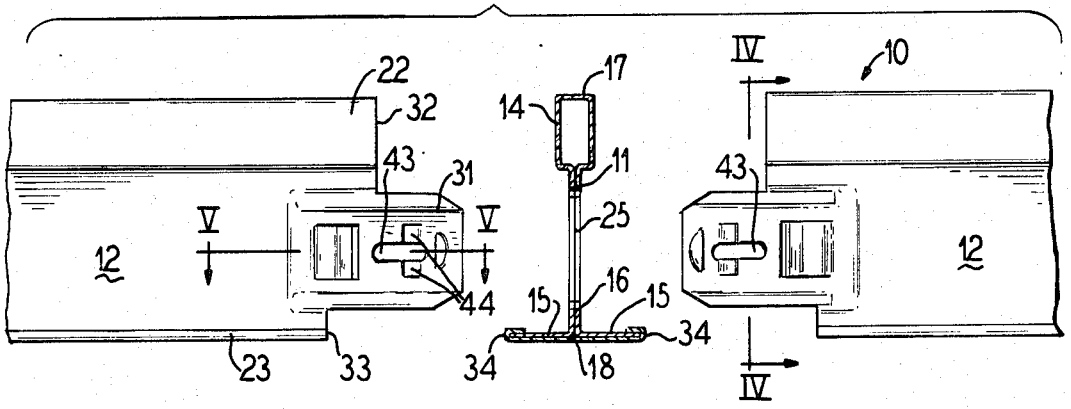
FIG. 1 is an exploded view of two cross members about to be inserted into an aperture of a main member from opposite sides.
Figure 4:
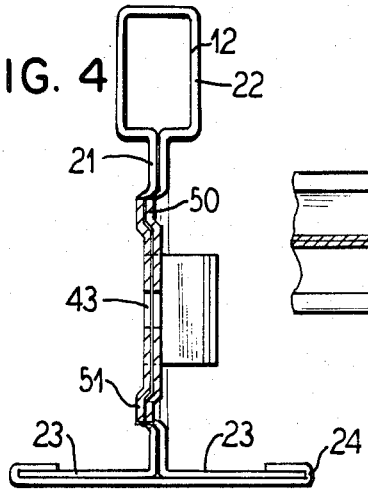
FIG. 4 is an enlarged cross-sectional view taken along the lines IV—IV of FIG. 1.

As best illustrated in FIG. 1, each of the main members 11 is composed of a pair of bent sheet metal pieces or strips. One sheet metal strip 14 has a pair of right angle bends to form flanges 15, 15 which are connected by a web 16 to a bead 17. As illustrated, the bead 17 has a rectangular configuration. The other strip 18 is a sheet metal member bent over the flanges 15, 15 and presents a surface which will appear on the suspended ceiling. The strip 18 can be provided with paint of different colors in accordance with the desired aesthetic requirements. Each of the cross members or tees 12 have the same configuration and structure as the main member 11 with a web 21 interconnecting a rectangular bead 22 to a pair of flanges 23, 23 which are covered on the bottom by an additional strip 24 (see FIG. 4).

Figure 6:
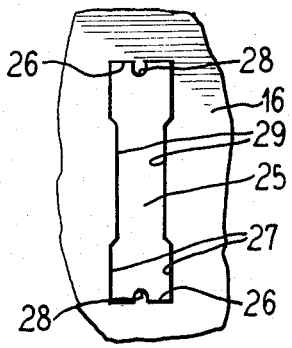
FIG. 6 is an enlarged view of an elongated aperture formed in the web of the T members of the present invention.

The web 16 has an elongated aperture or slot 25 which is best illustrated in FIG. 6. As illustrated, the slot 25 has a substantially rectangular configuration with short sides 26, 26 and long sides 27, 27. Each of the short sides is provided with a projection or nib 28 while each of the long sides have a shallow projection 29. The function of the projections 28 as well as the shallow projections 29 will be discussed hereinafter.

Figure 2:
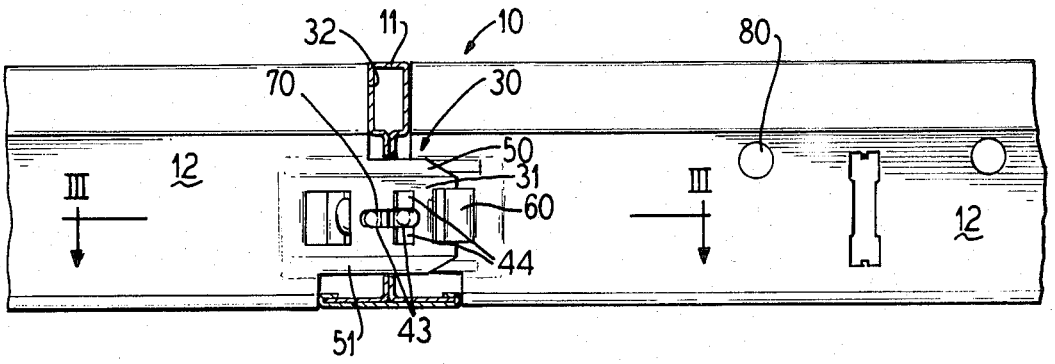
FIG. 2 shows the connection after insertion of the two cross members of FIG. 1.
Figure 3:
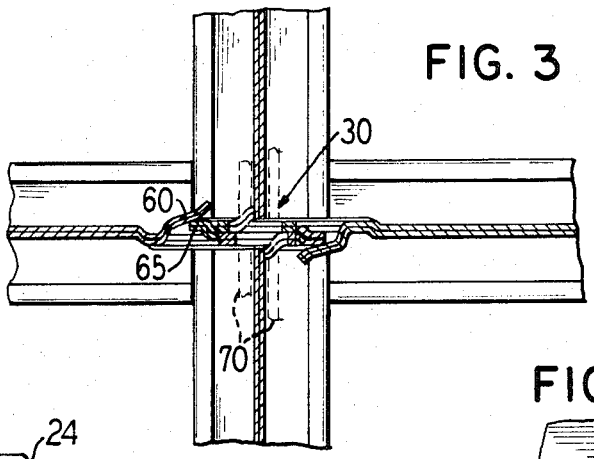
FIG. 3 is a cross-sectional view taken along the lines III—III of FIG. 2.

In order to form a connection generally indicated at 30 in FIGS. 2 and 3, each of the webs 21 of the cross members have a tongue 31 which extend beyond both an end surface 32 of the bead 22 and also end surfaces 33 of the flanges 23. The tongues 31 are inserted in the slot or aperture 25 as illustrated in FIGS. 2 and 3, the end surfaces 33 will engage an edge 34 of the flange of the main member 11 as the end surface 32 of the bead 22 engages a surface of the bead 17. Thus, a substantially rigid connection 30 is formed.

To hold the tongue in the slot 25, first means are provided on the tongue to lock it therein. In addition, each tongue has second means, which cooperate with second means of an adjacent tongue to form an end-to-end connection therebetween as illustrated in FIG. 3.

Figure 5:
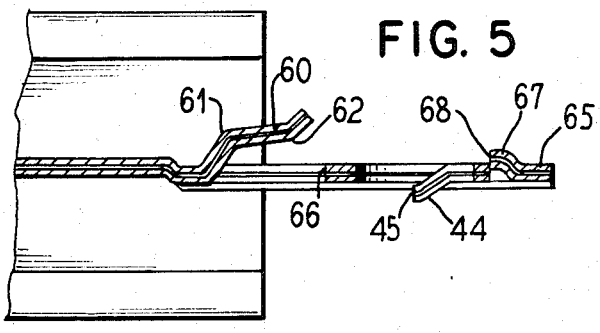
FIG. 5 is a cross-sectional view taken along the lines V—V of FIG. 1.

The first means, as best illustrated in FIGS. 1 and 2, includes a flap or tab which is bent out of the plane of the tongue as best illustrated in FIG. 5 and has been subdivided by an oblong aperture 43 that extends parallel to the bead 12. The aperture 43 thus causes two flaps or tabs 44 which provide two abutment surfaces 45 which will engage an edge of the aperture 25 after the tongue has been inserted into the position illustrated in FIG. 2. Preferably, each of the tongues is slightly offset by an amount of approximately one-half of the thickness of the web from the plane of the web. In addition, two embossments 50 and 51 are formed along the upper and lower edges of the tongue 31 to reinforce or stiffen the tongue (see FIG. 4). As illustrated, this gives a rather slight bowed configuration for the tongue which conforms to one-half of the shape of the aperture 25 when subdivided by the two projections or nibs 28, 28.

The second means, which coacts with the second means of the tongue inserted from the opposite side to form an end-to-end connection, includes a tab 60 which is cut and formed, as best illustrated in FIG. 5, to the opposite side from the tabs 44. The tab 60 as illustrated has several intermediate bends such as 61 and 62 and forms a catch for receiving a free end 65 of the other tongue (see FIGS. 2 and 3). Also, the forming of the tab creates an aperture with an edge forming an abutment surface 66. Adjacent the free end 65 of the tongue, another embossment or projection 67 is formed to provide an abutment surface 68. The projection 67, as best illustrated in FIGS. 2 and 3, will be received in the aperture formed by bending the tab 60 out of the plane of the tongue with the edge 68 engaging the abutment surfaces 66. This occurs as the free end 65 is engaged by the tab 60 of the opposite facing tongue. The coaction of the tab 60 holds the abutment surface 68 in engagement with the abutment surface 66 to lock the two members together and it should be noted that in each instance the two members are locked on opposite sides of the web 16 of the main member 11.

As mentioned hereinabove, each of the tongues has a slot 43 which when the tongues are joined together as illustrated in FIG. 2, are aligned with each other and form apertures on each side of the web 16 to enable insertion of a clip 70 which is shown in broken lines in FIG. 3 and will positively lock the members together. The clip means 70 may be what is known as a seismic clip which will prevent any possible disengagement of the joint or connection 30 even when subjected to seismic vibrations.

By providing the slot 43 to subdivide the tab into two tabs 44, spaced points of contact are obtained by the abutment surfaces 45 on the periphery such as at the projections 29 of the web surrounding the aperture 25. The projections or nibs 28 in the aperture 25 hold the tongue 31 on one side of the aperture and prevent disengagement of the abutment surfaces 45 of the tabs 44. In addition, the double thickness of the sheet metal forming the web 21 and the tongue 31 tend to resiliently bias each of the members outward to insure a tight fit.

As mentioned hereinabove, the runners 11 and the cross members 12 are for a suspended ceiling system. In order to suspend the ceiling, each of the members is provided with apertures such as 80 in the member 12 to enable suspending the member from above. In most instances, the main members 11 are suspended by wires in a conventional manner and the cross member 12 are then inserted.

It should also be noted that the main member 11 may be formed with a conventional interlocking tongue on an end. Thus, two members 11 can be spliced together as necessary.

Although various minor modifications may be suggested by those versed in the art, it should be understood that we wish to embody within the scope of the patent granted hereon, all such modifications as reasonably and properly come within the scope of our contribution to the art.

We claim:

1. A suspended ceiling system comprising main members extending parallel to each other and cross members extending between the main members at spaced intervals, each of said members having an inverted tee configuration with a pair of oppositely extending flanges connected by a web portion to a bead, each cross member having ends with an end surface of the bead extending beyond end surfaces of the flanges by an amount slightly less than the width of a single flange and the web portion having a tongue extending beyond both the end surfaces of the bead and flanges, each of the webs of the main members having elongated slots for receiving the tongue of the cross member with the end surface of the bead contacting the bead of the main member as the end surfaces of the flange of the cross member engage an outer edge of the flange of the main member, each of the tongues having first means cooperating with the elongated slot to lock the tongue in the slot and second means cooperating with second means of another tongue to interconnect the two tongues together to form an end-to-end joint between cross members extending into the elongated slot from opposite directions, said first means including a pair of tabs forming a pair of catch surfaces facing away from the end of the tongue, said tabs being spaced apart by an elongated aperture extending parallel to the bead and being positioned in the tongue with a portion extending on each side of the web of the main member to provide apertures for receiving clip means for positively locking the cross member to the main member.

2. A suspended ceiling system according to claim 1, wherein the second means includes an embossment extending to a side opposite the tabs adjacent a free end of the tongue, said embossment forming an abutment surface and a tab formed in the base of the tongue to provide an engagement edge and a flap extending to the same side as said embossment so that the abutment surface of the embossment will be engaged on the engagement edge of the other cross member as the free end is received by the flap when the two cross members are inserted from opposite sides through the aperture in the web of the main member.

3. A suspended ceiling system according to claim 2, wherein the webs of the cross member have a double thickness so that the spaced abutment surfaces are of a double thickness.

4. A suspended ceiling system according to claim 1, wherein the elongated slot has a rectangular configuration with narrow sides being subdivided by nibs and the long sides being provided with flat projections, said flat projections being engaged by the catch surfaces of the first means as the nibs hold the tongue against the long edge.

5. A suspended ceiling system according to claim 4, wherein the tongue is offset by an amount approximately equal to half the thickness of the web and is provided with reinforcing embossments along the upper and lower edge to give a bowed configuration, said bowed configuration corresponding to the configuration of half of the elongated slot in the web of the main member.

6. A suspended ceiling system according to claim 5, wherein the embossments and the two tabs forming the catch surfaces extend toward the same side.

7. A suspended ceiling system according to claim 6, wherein the second means comprises a second embossment adjacent the free end of the tongue forming a second catch surface, said second embossment extending to the opposite side from said tab and a flap extending in the same direction as the second embossment forming an abutment edge cooperating with the second catch surface of a tongue inserted from the opposite direction as the free end of the tongue is held by said flap with the second catch surface engaged on the abutment edge.

8. A suspended ceiling system according to claim 7, wherein at least the web of the cross members has a double thickness so that the spreading of the portions of the tongue act to resiliently urge the abutment surfaces and catch surfaces into engagement with the respective surfaces when forming the first and second means.

9. A suspended ceiling system according to claim 6, wherein at least the web of the transverse member has a double thickness.

* * * * *